US005345637A

United States Patent [19]

Pastryk et al.

[11] Patent Number: 5,345,637

[45] Date of Patent: Sep. 13, 1994

[54] HIGH PERFORMANCE WASHING SYSTEM FOR A HORIZONTAL AXIS WASHER

[75] Inventors: Jim J. Pastryk, Weesaw Township, Berrien County; Devinder Singh, St. Joseph Township, Berrien County; Tracy M. Smart, Lincoln Township, Berrien County, all of Mich.

[73] Assignee: Whirlpool Corporation, Benton Harbor, Mich.

[21] Appl. No.: 52,600

[22] Filed: Apr. 27, 1993

[51] Int. Cl.[5] ..... D06F 21/04; D06F 39/02; D06F 39/08

[52] U.S. Cl. ..... 8/158; 8/159; 68/17 R; 68/23.5; 68/58; 68/148; 68/207

[58] Field of Search ..... 8/158, 159; 68/17 R, 68/23.5, 58, 148, 207

[56] References Cited

U.S. PATENT DOCUMENTS

| | | | |
|---|---|---|---|
| 2,721,574 | 10/1955 | Parker | 137/122 |
| 2,920,469 | 1/1960 | Henshaw, Jr. | 68/12 |
| 3,197,980 | 8/1965 | Marple | 68/12 |
| 4,489,574 | 12/1984 | Spendel | 68/16 |
| 4,624,118 | 11/1986 | Yamakawa et al. | 68/12 R |
| 4,777,682 | 10/1988 | Dreber et al. | 8/158 |
| 4,782,544 | 11/1988 | Nystuen et al. | 8/159 |
| 4,784,666 | 11/1988 | Brenner et al. | 8/137 |
| 4,843,671 | 7/1989 | Hirooka et al. | 8/159 |
| 4,987,627 | 1/1991 | Cur et al. | 8/158 |
| 5,191,669 | 3/1993 | Euler et al. | 8/158 |

*Primary Examiner*—Philip R. Coe

*Attorney, Agent, or Firm*—Joel M. Van Winkle; Stephen D. Krefman; Robert O. Rice

[57] ABSTRACT

A wash system is provided having a rotatable wash basket for receiving fabric items disposed within an imperforate wash tub. A quantity of wash liquid is initially applied to the fabric items while the fabric items are tumbled within the wash basket until the fabric items are saturated with wash liquid and have had a chance to roll-up. The washing liquid is then extracted from the fabric items and the extracted wash liquid is stored for later use in a holding tank. A portion of the stored wash liquid is reintroduced from the holding tank to a mixing tank and mixed with detergent to form a wash liquor having a detergent concentration within a predetermined range. This wash liquor is then continuously passed through the fabric items while the wash basket rotates at a speed to maintain the fabric items against a peripheral wall of the wash basket.

42 Claims, 7 Drawing Sheets

HIGH PERFORMANCE WASHING SYSTEM FOR A HORIZONTAL AXIS WASHER

BACKGROUND OF THE INVENTION

The present invention relates to a system for washing fabric in an automatic clothes washer and more particularly to a high performance system for washing fabrics in a horizontal axis washer that includes a fabric saturation step and a concentrated detergent solution washing operation.

Attempts have been made to provide an automatic clothes washer which provides comparable or superior wash results to present commercially available automatic washers, yet which uses less energy and water. For example, such devices and wash processes in a vertical axis machine are shown and described in U.S. Pat. Nos. 4,784,666 and 4,987,627, both assigned to the assignee of the present application, and incorporated herein by reference.

The basis of these systems stems from the optimization of the equation where wash performance is defined by a balance between the chemical (the detergent efficiency and water quality), thermal (energy to heat water), and mechanical (application of fluid flow through—fluid flow over—fluid impact—fabric flexing) energy inputs to the system. Any reduction in one or more energy forms requires an increase in one or more of the other energy inputs to produce comparable levels of wash performance.

Some prior art wash methods for horizontal axis washers, wash the fabric load in a concentrated detergent solution for the purpose of enhancing soil removal or reducing the amount of water consumed during the wash operation. For example, U.S. Pat. No. 4,489,455 discloses a horizontal axis washer which utilizes a reduced amount of wash fluid in a washing cycle in which the wash fluid is applied onto the fabric load and then the load is tumbled in the presence of the wash fluid for a given period of time. Recirculation of the wash liquid does not occur.

U.S. Pat. No. 3,197,980, assigned to the assignee of the present invention, discloses a horizontal washer and wash cycle in which the clothes load is subjected first to a deep fill to thoroughly wet all of the clothes, half the water is then removed from the washer and a normal detergent supply is introduced into the remaining wash bath. Thus, a "concentrated" detergent solution in the range of 0.40 to 0.50% by weight is applied to the clothes load during a tumbling agitation of the clothes. Recirculation of the wash fluid during this "concentrated" wash cycle is also disclosed. Following the "concentrated" portion of the wash cycle, the tub is refilled to a deep fill volume which dilutes the detergent concentration to the normal concentration of 0.20 to 0.25%. An additional tumble period at the normally recommended detergent concentration then occurs.

Significantly greater savings in water usage and energy usage than is achieved by heretofore disclosed wash systems and methods would be highly desirable.

SUMMARY OF THE INVENTION

A horizontal axis washer system incorporating the principles of the present invention utilizes a basket structure and fluid conduits and valves which complement specifically increasing the level of chemical contributions to the wash system, therefore permitting the reduction of both mechanical and thermal inputs.

The utilization of concentrated detergent solution concepts permits the appliance manufacturer to significantly reduce the amount of thermal and mechanical energy applied to the clothes load, through the increase of chemistry a minimum of thirteen fold and maximum up to at least sixty-four fold, while approximating "traditional" cleaning levels, yet reducing the energy and water usage. This translates to washing with reduced water heating, reduced water consumption, and minimal mechanical wash action to physically dislodge soils. A concentrated detergent solution is defined in U.S. Pat. No. 4,784,666 as 0.5% to 4% detergent by weight. It is anticipated now, however, that a concentrated detergent solution may be as high as 12% by weight.

The present invention provides for an improvement in a method for combining a high speed spin and a low speed spin wash action to complement the concentrated detergent solution concepts in a horizontal washer approach as described in patent application Ser. No. 07/815,774, now U.S. Pat. No. 5,191,669, assigned to the assignee of the present invention.

In patent application Ser. No. 07/815,774, a wash process is described wherein the wash chamber holding the fabric is rotated at a speed to effect less than a one gravity centrifugal force of the fabric so that the fabric will tumble in the wash chamber. A recirculating spray of concentrated detergent solution is directed onto the fabric for a first period of time as the fabric is tumbling in the wash chamber.

After the first period of time, the speed of the wash chamber is increased to effect more than a one gravity centrifugal force on the fabric so the fabric will be held against the basket wall. The recirculating spray of concentrated detergent solution is continued against the fabric for a second period of time. This method of spinning the fabric items at a high speed while spraying a highly concentrated detergent solution on the spinning clothes is referred to as a high performance method of washing. In this process, ideally, the amount of highly concentrated detergent solution used is only slightly in excess of the amount required to saturate the clothes at the given rotational speed.

The Applicants have found, however, that occasionally during the high speed spin portion of the wash process described above, one or more of the fabric items being washed will span the entire diameter of the wash basket. This may particularly occur during the washing of large fabric items such as shirts, sheets or towels, wherein at the initiation of high speed spin, one or more of the items are disposed in the wash basket at the center of rotation. As the rotation speed of the wash basket is increased, items within the wash basket are urged radially outward and forced against the peripheral wall of the wash basket. Fabric items disposed at the center of rotation, however, have different portions urged radially outward opposite each other such that the item may span the diameter of the wash basket. This results in poor wash performance because the fabric item spanning the diameter of the wash basket during high speed spin may block the recirculating spray of concentrated detergent solution.

The Applicants have discovered, however, that this problem, labeled "bridging" by the applicants, may be overcome by initially saturating the fabric items with wash liquid while tumbling them prior to high speed spinning. As may be understood by those skilled in the art, when fabric items are tumbled while being saturated with wash liquid, they have a tendency to reduce their volume and roll-up or ball. Rolling-up or balling may be understood to describe the phenomena of fabric items twisting upon themselves during tumbling within a wash basket when the fabric items are saturated. This reduction in volume of the fabric items, therefore, substantially reduces the likelihood that any fabric item may be disposed at the axis of rotation when high speed spin occurs and further the rolled-up condition of the saturated fabric items reduces the likelihood that any fabric items may unroll and span the diameter of the wash basket.

It has been determined, however, that the quantity of water required to fully saturate the fabric items tumbling within the wash basket, ordinarily substantially exceeds the amount of water desired for mixing with a detergent for creating a concentrated detergent wash liquor for use in a high performance method of washing. The amount of water required for fully saturating the fabric items while tumbling would require an undesirably large amount of detergent to create the desired concentration of detergent wash liquor. Therefore, it would be highly desirable if a method and apparatus were provided for fully saturating fabric items tumbling in a wash basket prior and using only a portion of the water used for saturating the fabric items to form a concentrated wash liquor for use in the high performance method of washing.

Accordingly, the present invention contemplates a wash system having a rotatable wash basket for receiving fabric items disposed within an imperforate wash tub. A quantity of water is initially applied to the fabric items while the fabric items are tumbled within the wash basket until the fabric items are fully saturated with water and have had a chance to roll-up. The water is then extracted from the fabric items and the extracted water is stored for later use in a holding tank. A portion of the stored water is then sent from the holding tank to a mixing tank and mixed with detergent to form a wash liquor having a detergent concentration within a predetermined concentration range. This wash liquor is then continuously passed through the fabric items while the wash basket rotates at a speed to maintain the fabric items against a peripheral wall of the wash basket.

One object of the invention, therefore, is to prevent the phenomenon of bridging during high speed spin when the application of a concentrated detergent solution is applied.

Another object is to initially saturate the fabric items within a rotating wash basket with water for preventing the phenomenon of bridging and to reuse the water used for initial saturation of the fabric items.

DESCRIPTION OF THE PREFERRED EMBODIMENTS

Figure 1:
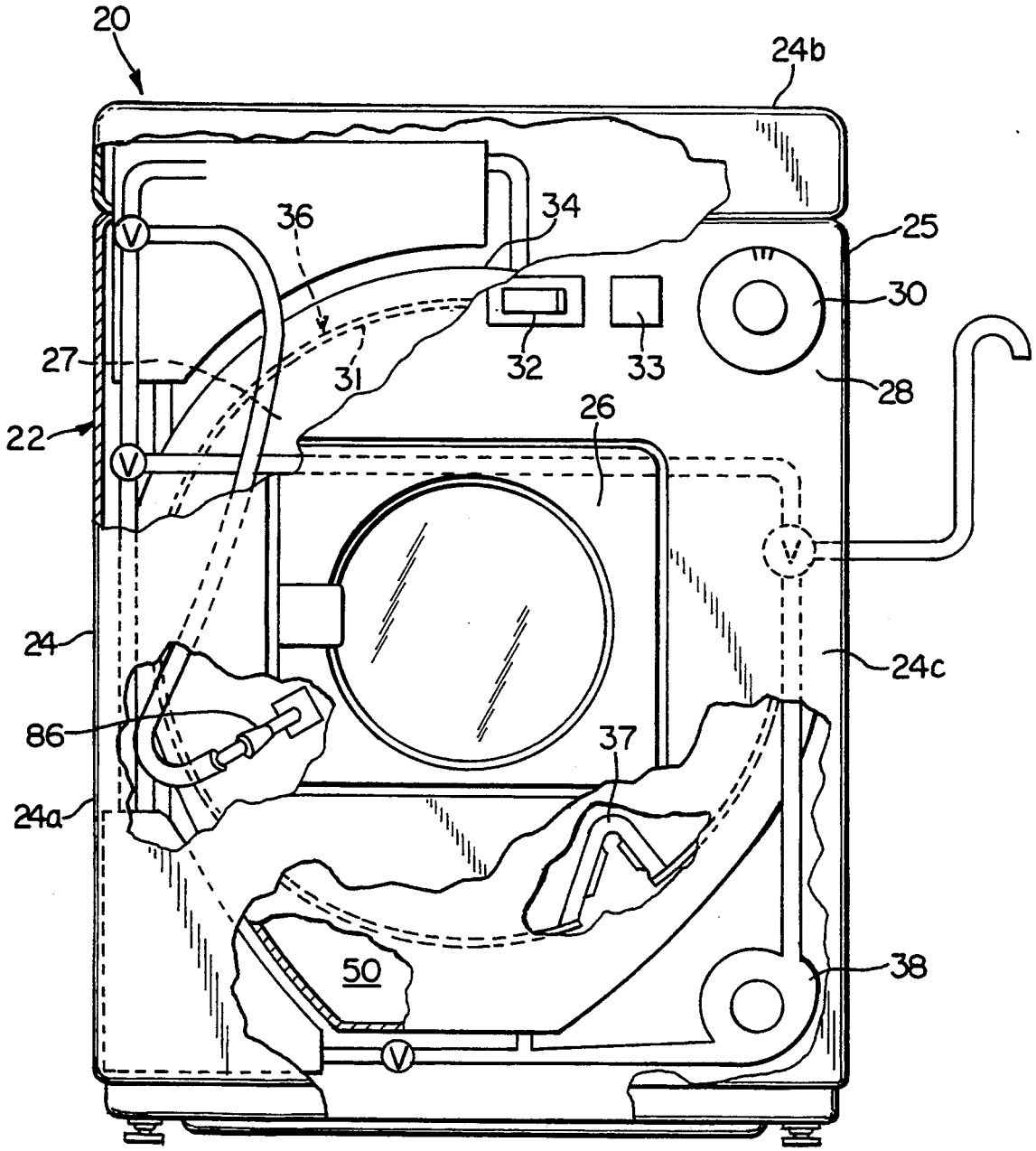
FIG. 1 is a front view of a combined washer partially cut away to illustrate various interior components.

In FIG. 1, reference numeral 20 indicates generally a washing machine of the automatic type, i.e., a machine having a pre-settable sequential control means for operating a washer through a preselected program of automatic washing, rinsing and extracting operations in which the present invention may be embodied. The machine 20 includes a cabinet 22 having vertical panels 24 forming the sides 24*a*, top 24*b*, front 24*c* and back of the cabinet 25 for the washing machine 20. A hinged door 26 is provided in the usual manner to provide access to an interior portion or wash zone 27 of the washing machine 20. The washing machine 20 has a console 28 including a timer dial 30 or other timing mechanism and temperature selector 32 as well as a cycle selector 33 and other selectors as desired.

Internally of the machine 20 described herein by way of exemplifications, there is disposed an imperforate fluid containing wash tub 34 within which a spin wash basket 36 with perforations or holes (not shown) is concentrically carried. A pump 38 is provided below the tub 34 and is fluidly interconnected with the tub 34. The basket 36 consists of a peripheral wall 31 which defines the wash zone 27. A motor (not shown) is operatively connected to the basket 36 to rotate the basket relative to the wash tub 34.

The wash basket 36 has a plurality of inwardly directed baffles 37 to engage and lift the fabric as the basket 36 rotates about its horizontal axis. The wash basket 36 also is provided with a series of apertures (not shown) therethrough to permit fluid flow through the wash basket 36. When the basket 36 rotates at a sufficiently high speed, the fabric will be held against the wall 31 of the basket 36 in that a centrifugal force in excess of the force of gravity will be applied to the fabric, thus preventing the fabric from moving relative to the basket wall 31. However, when the basket 36 is rotated below a predetermined speed, less than one gravity of centrifugal force will be applied to the fabric, thus permitting the fabric to tumble within the basket 36. As described below, one or both of these spin actions may be applied during the preferred wash cycle.

Figure 2:
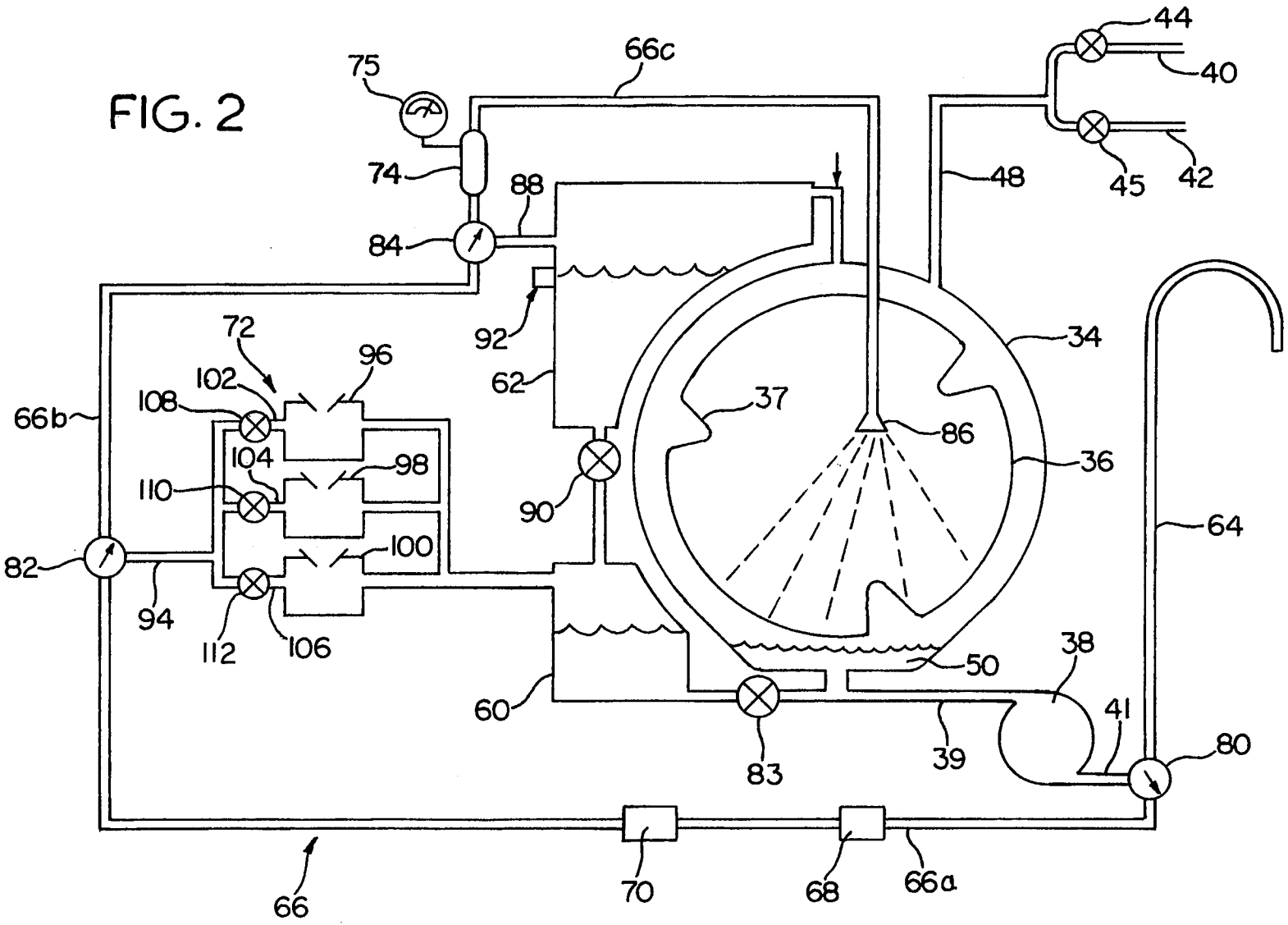
FIG. 2 is a schematic illustration of the fluid conduits and valves associated with the automatic washer.

Water is supplied to the imperforate wash tub 34 by hot water supply inlet 40 and cold water supply inlet 42 (FIG. 2). Fill valves 44 and 45 are connected to an inlet conduit 48 and contain built in flow devices to give the same rate of flow over wide ranges of inlet pressures. The bottom portion of the wash tub 34 defines a sump or collection zone 50 for collecting the water which is supplied to wash tub 34.

A mixing tank 60, as shown in FIG. 2, forms a zone for receiving, mixing and storing a concentrated solution of detergent during the wash cycle, and is used in some embodiments of the invention. A holding tank 62 forms a zone for receiving and storing water from the wash tub 34 which has only been used for initially saturating fabric items disposed in the wash basket 36 and is also used in some embodiments of the invention. The mixing tank 60 communicates at a top end with the holding tank 62 and at a lower end with an inlet conduit 39 for the pump 38. An outlet conduit 41 from the pump 38 is connected with a drain line or conduit 64 and a recirculation conduit 66. The mixing tank 60 may be similar to that disclosed in U.S. Pat. No. 4,784,666.

An optional in-line water heater 68 on recirculation conduit 66, or an immersion heater in the collection zone 50, offers the ability to increase the concentrated wash liquor to an elevated temperature level, thus providing high temperature wash performance at the reduced cost of heating one to one ana half gallons of water. This compares to the cost of heating four to five gallons of water in a traditional horizontal washer. The controlled use of an in-line heater 40 combined with high concentrated wash liquor offers special opportunities for specific optimization of detergent ingredients which are activated only in specific temperature ranges. Furthermore, the elevated water temperatures offer the ability to specifically target oily soil removal and reduce the build-up of both saturated and polyunsaturated oils in fabrics laundered in cold water.

The use of an in-line lint, button, sand and foreign object trap or filter 70 also on recirculation conduit 66, significantly reduces the potential for problems associated with recirculating fluid systems carrying soils and foreign materials. Such a filter is disclosed in U.S. Pat. No. 4,485,645, assigned to the assignee of the present invention, and incorporated herein by reference. Such optional devices may be utilized in a preferred system.

A dispenser arrangement 72 is further provided and includes a plurality of wash additive dispensers 96, 98 and 100. Dispensers 96 and 98 may be used for dispensing additives such as bleach or fabric softeners and dispenser 100 may be used to dispense detergent (either liquid or granular) into the wash load at the appropriate time in the automatic wash cycle. Each of the dispensers 96, 98 and 100 are supplied with liquid (generally fresh water or wash liquid) through a separate, dedicated conduit 102, 104, 106 respectively. Each of the dedicated conduits 102, 104 and 106 may be connected to a fluid source in a conventional manner, as by solenoid operated valves 108, 110 and 112, respectively.

Figure 3A:
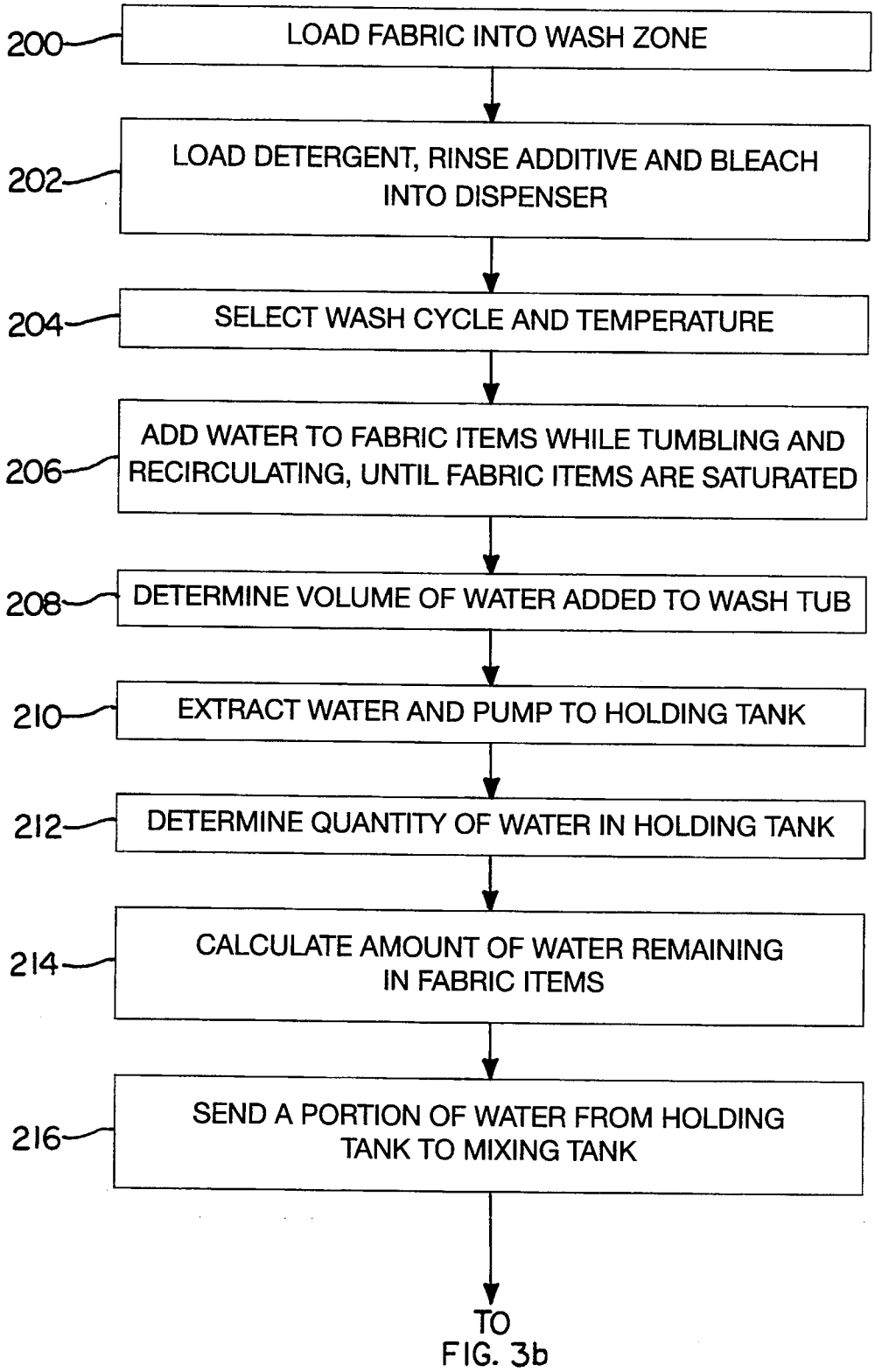
FIGS. 3*a* and 3*b* are a flow chart diagram of the wash cycle of the subject invention.
Figure 3B:
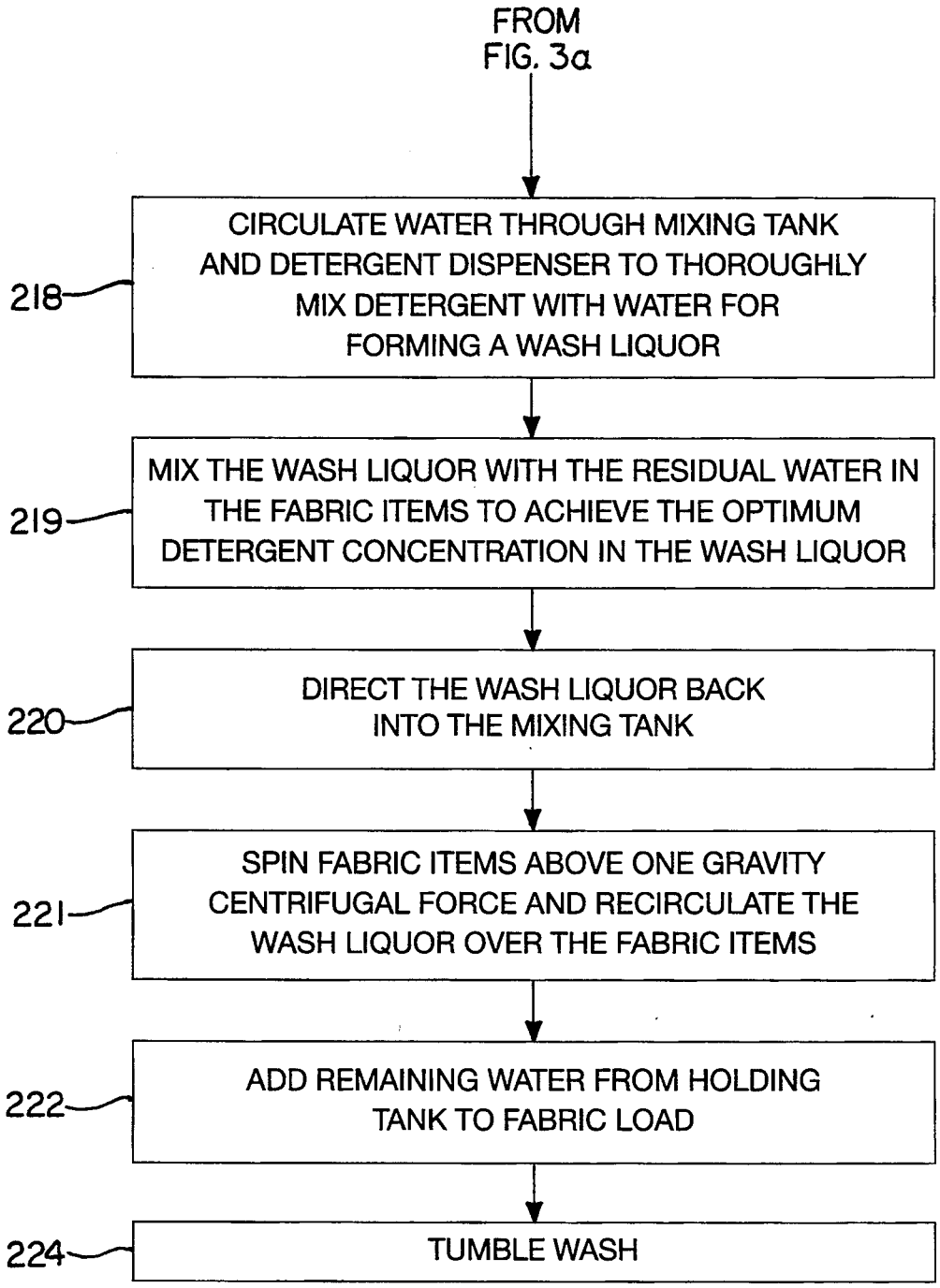

Referring now to FIGS. 3*a* and 3*b* in conjunction with FIG. 2, the operation of the washing machine may be understood. In step 200, the washer is loaded with fabric items as would be standard in any horizontal axis washer. In step 202, the detergent, rinse additives and/or bleach are loaded into the dispenser arrangement 72. The consumer then selects the desired cycle and water temperature in step 204.

To prevent the phenomenon of bridging from occurring, as discussed earlier, the fabric items must be thoroughly wetted or saturated with wash liquid, preferably water, while the fabric items tumble freely at a normal tumble speed. Therefore, in step 206, wash liquid is added to the wash tub 34 and recirculated through the fabric load while the fabric items are tumbled within the wash basket 36 for saturating the fabric items. A series of clockwise and counter-clockwise wash basket rotations are used to achieve a wetting and tumbling action which is sufficient to cause the individual fabric items to reduce their volume and begin to roll-up or ball upon themselves without tangling with other fabric items.

The amount of wash liquid added in step 206 is determined as adequate for saturating the tumbling fabric items when a pressure switch 75, fluidly interconnected with an air dome 74, is satisfied. During step 206, wash liquid is added to the tub 34 through inlet conduit 48 and is applied to the fabric load through the perforation in the peripheral wall of wash basket 36 and the open backed baffles 37 which are provided with holes for draining the wash liquid onto the fabric items. A first three-way valve 80 is oriented to allow the pump 38 to attempt to recirculate the wash liquid through a first conduit portion 66*a* of the recirculation conduit 66. A second three-way valve 82 and third three-way valve 84 are oriented to direct recirculating wash liquid through second and third conduit portions, 66*b* and 66*c* of the recirculation conduit 66 such that the recirculated wash liquid is sprayed onto the tumbling fabrics by a spray nozzle 86. An adequate quantity of wash liquid for fully saturating the fabric items in the wash basket 36 is determined by the pressure switch 75 on the third conduit portion 66*c* when enough wash liquid has been added to the wash tub 34 such that wash liquid is continuously available to supply the inlet of the pump 38 such that the pump 38 can pressurize the recirculation conduit 66 during the recirculation of wash liquid onto the tumbling fabric items. When the pressure switch 75 indicates an adequate quantity of wash liquid has been added to the wash tub 34, the fill valves 44 and 45 are closed. The total amount of wash liquid added to the wash tub 34 can then be calculated in step 208 by multiplying the time the fill valves 44 and 45 were open by their respective flow rates. As contemplated by the inventors, an adequate quantity of wash liquid could also be determined by other water level sensing means such as: a pressure switch in the collection zone 50; resistance probes located in the collection zone 50; or a float devise located in the collection zone 50 as well as other well known water level sensing means.

In step 210, the wash basket may be spun at a speed to extract the wash liquid from the fabric items after they have been reduced in volume and rolled-up. This extracted wash liquid flows to the collection zone 50 and may be pumped from there to the holding tank 62 by closing the third three-way switch 84 to redirect the recirculating wash liquid through conduit 88 to the holding tank 62. A dump valve 90 is closed to prevent the wash liquid in the holding tank from draining to the mixing tank 60. When all of the wash liquid extractable from the fabric items has been pumped to the holding tank 62, a wash liquid level sensing means 92 is used to determine the total quantity of wash liquid in the holding tank as shown in step 212. The wash liquid level sensing means 92 may be a pressure switch, a float switch or any other well known liquid level sensing means. In step 214, the amount of residual wash liquid remaining in the fabric items after extraction may then be calculated from the difference between the total amount of wash liquid added to the wash tub 34 calculated in step 208, and the amount of wash liquid extracted and sent to the holding tank 62 determined in step 212.

The dump valve 90 may then be opened to drain a portion of the wash liquid from the holding tank 62 to the mixing tank 60 as indicated in step 216. The amount of wash liquid added to the mixing tank 60 is controlled such that it equals an optimum amount of wash liquid for mixing with the detergent when combined with the amount of residual wash liquid remaining in the fabric items. More particularly, the amount of wash liquid drained from the holding tank 62 to the mixing tank 60 is of a quantity that when combined with residual wash liquid still in the fabric items, equals the optimum quantity of wash liquid to mix with the detergent added in step 202 to create a wash liquor having a detergent concentration of between 0.5% to 12% by weight detergent. It is contemplated by the inventors that the size of the wash basket 36 and size of the detergent dispenser 100 will result in the optimum quantity of washing liquid for mixing with the detergent will be approximately six liters.

In step 218, the wash liquid supplied to the mixing tank 60 is then circulated through the dispenser arrangement 72 by operating the pump 38 and closing the second three-way valve 82 such that washing liquid is directed through conduit 94 to the dispenser arrangement 72. Valve 108 is opened such that the pump 38 recirculates wash liquid through the detergent dispenser 100 for thoroughly mixing the water and detergent for forming the concentrated detergent wash liquor.

In step 219, the concentrated detergent wash liquor is mixed with the residual wash liquid in the fabric items. This is accomplished by recirculating the wash liquor in the mixing tank 60 through the wash basket 36 while the wash basket 36 is spinning. The residual wash liquid in the fabric items, therefore, may mix with the concentrated wash liquor in the mixing tank 60 for achieving the desired detergent concentration level in the wash liquor. In step 219, therefore, a drain valve 83 is opened to feed the pump 38. The second three-way valve 82 and the third three way valve 84 may be opened such that the pump 38 may recirculate the wash liquor through the fabric items while the wash basket 36 is spun at approximately 110 RPM. After the concentrated wash liquor has been thoroughly mixed, the second three-way valve 82 may be closed to redirect the wash liquor back into the mixing tank 60 as described in step 220. As currently contemplated by the inventors, steps 219 and 220 may be omitted if the amount of residual water retained in the fabric items after extraction is relatively small when compared to the quantity supplied to the mixing tank 60.

Once the concentrated detergent wash liquor has been thoroughly mixed, the high performance wash process step 221 may be initiated. In step 221, therefore, the drain valve 83 may be opened to supply wash liquor to the pump 38 inlet. The second three-way valve 82 and the third three-way valve 84 are opened such that the wash liquor is circulated through recirculation conduit 66 for spraying the fabric items with wash liquor while the wash basket 36 is spun at a speed of around 300–800 RPM. This speed forcibly urges the fabric items against the peripheral wall of the wash basket 36. The drain valve 83 shuts when an adequate amount of wash liquor has been supplied for recirculation during this high speed spin step. The amount of wash liquor required is typically less than the total amount of wash liquor in the mixing tank 60 and therefore, some quantity of wash liquor remains unused in the mixing tank 60. The concentrated detergent solution is forced through the fabric items and through the basket holes due to the centrifugal force imparted by the spinning basket 36 with potential significant contributions by mechanical fluid flow through the fabric defined by the pumping rate of the detergent liquor. During this step (221), the concentrated detergent solution will be recirculated through the fabric items for some predetermined period of time specified by the cycle type. That is, a cycle seeking maximum performance may recirculate the detergent solution through the fabric items for 14 minutes or more, while a more delicate or less soiled load will attempt to minimize the length of spinning.

The high speed spin/recirculation portion of the cycle is terminated after the designated time and the holding tank dump valve 90 is opened to permit the draining of any remaining water in the holding tank 62 into mixing tank 60 as described in step 222. The drain valve 83 is then opened to supply the diluted wash liquor in the mixing tank 60 to the fabric items.

The second concentrated detergent solution spray portion of the wash cycle, step 224, differs from the first in that the spin speed should now be reduced below that which will create a one gravity centrifugal force, to ensure the fabric items can loosely tumble, while the somewhat diluted yet still concentrated wash liquor is recirculated over the fabrics. In this step 224, the concentrated detergent solution is diluted somewhat, but not so much as to reduce the concentration to the normal concentration level of 0.05–0.28%.

Thus, the detergent concentration in the step 224 will be above 0.28%. The additional water dilution is necessary due to the reduced extraction in the tumble mode versus the high speed spin mode. That is, with the centrifugal force reduced, the fabric items will hold a greater volume of wash fluid prior to saturation. This preferred second mode permits a further improvement in the level of uniformity of application of concentrated liquor and ultimately the uniform removal of soils. During the second mode of concentration liquor application, significant performance levels can be achieved due to specific designing/engineering of the application of thermal inputs to capitalize on the chemical benefits for specific detergent components not normally available in traditional horizontal wash systems.

The tumbling portion of the cycle has the objective to provide sufficient detergent liquor fluid flow "through" and "over" the fabric items combined with fabric flexing and flagging. The resulting wash liquor flow patterns appear as complex non-laminar flow, fundamental in classical removal of micelle formations sequestering both oily and particulate soils. The utilization of the recirculated spray throughout the tumble portion of the wash recycles wash liquor draining through holes in the fully perforated basket 36 provides water conservation, and further assists in the application of wash liquor flow through and over the wash load.

One of the objectives of this wash system is to minimize water consumption. While the preferred design utilizes a perforated basket, other systems could utilize nearly solid baskets. Opportunities provided by a nearly solid basket include increased ease to maintain concentrated wash liquor in the fabric items and basket. The lack of basket holes reduces the rate and level of extraction of wash liquor and allows the wash liquor to increase its contact time with the clothes instead of reduced contact time required for recirculation through plumbing.

Figure 4:
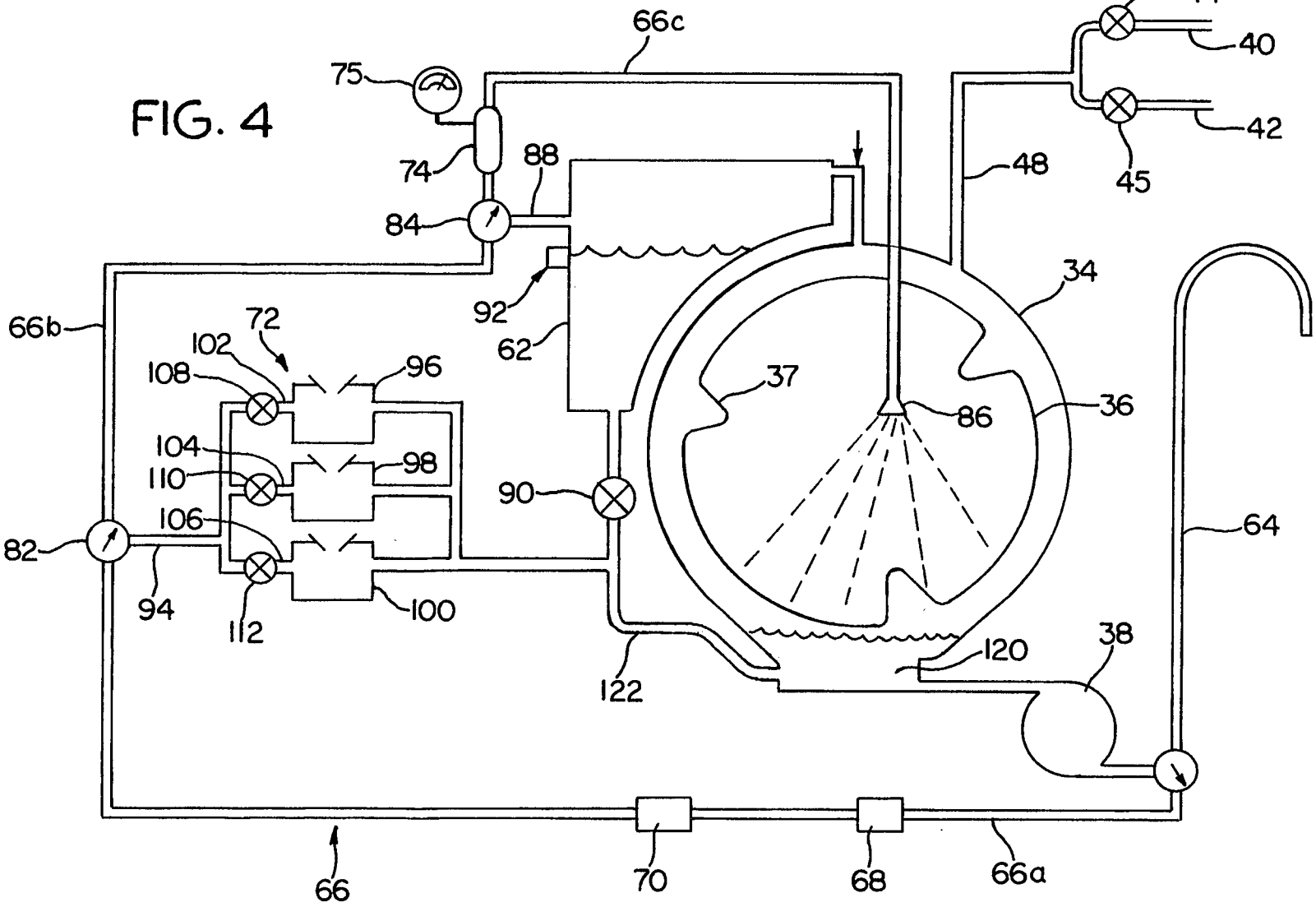
FIG. 4 is a schematic illustration of an alternative embodiment of the fluid conduits and valves associated with the automatic washer.

An alternate embodiment of the present invention may be understood by referring to FIG. 4. In FIG. 4, a schematic illustration of the fluid conduits and valves associated with the automatic washer is shown which is substantially similar to FIG. 2 which is described above. However, in this configuration, the mixing tank 60 has been omitted and replaced by an enlarged collection zone 120.

In operation, this alternate embodiment differs from the above description in several steps. In step 216, wherein previously water from the holding tank 62 is dumped to the mixing tank 60, the dump valve 90 now sends water directly to the enlarged collection zone 120 through a conduit 122. Furthermore, in this alternate embodiment step 218 is revised such that the concentrated detergent wash liquor is formed by circulating water through the enlarged collection zone 120 and the detergent dispenser 100 to thoroughly mix the concentrated detergent wash liquor.

Figure 5:
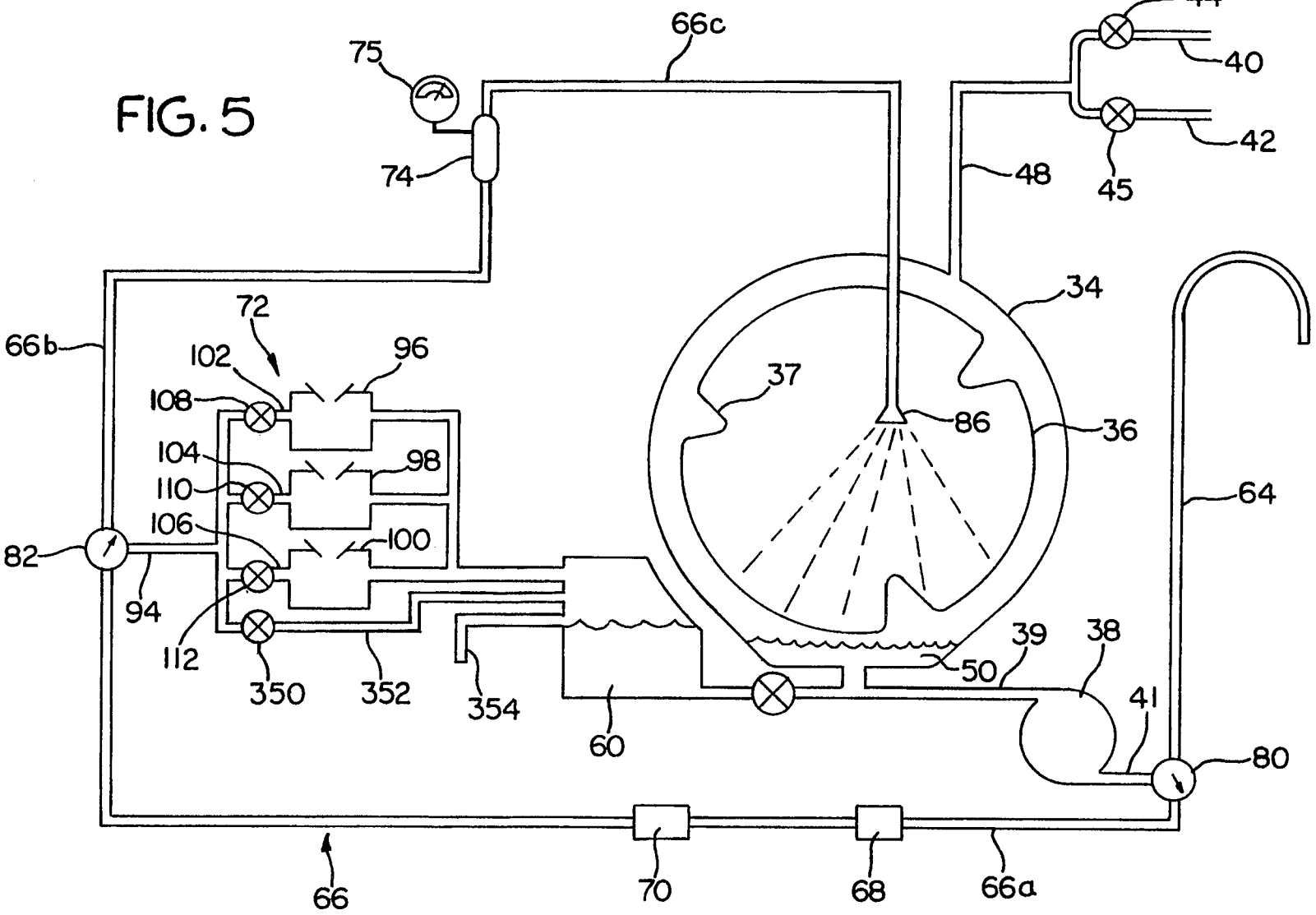
FIG. 5 is a schematic illustration of a second alternative embodiment of the fluid conduits and valves associated with the automatic washer.

A second alternative embodiment of the present invention may be understood by referring to FIG. 5. In FIG. 5, a schematic illustration of the fluid conduits and valves associated with the automatic washer is shown which is substantially similar to FIG. 2, which is described above. However, in this configuration, the holding tank 62 has been omitted.

Figure 6:
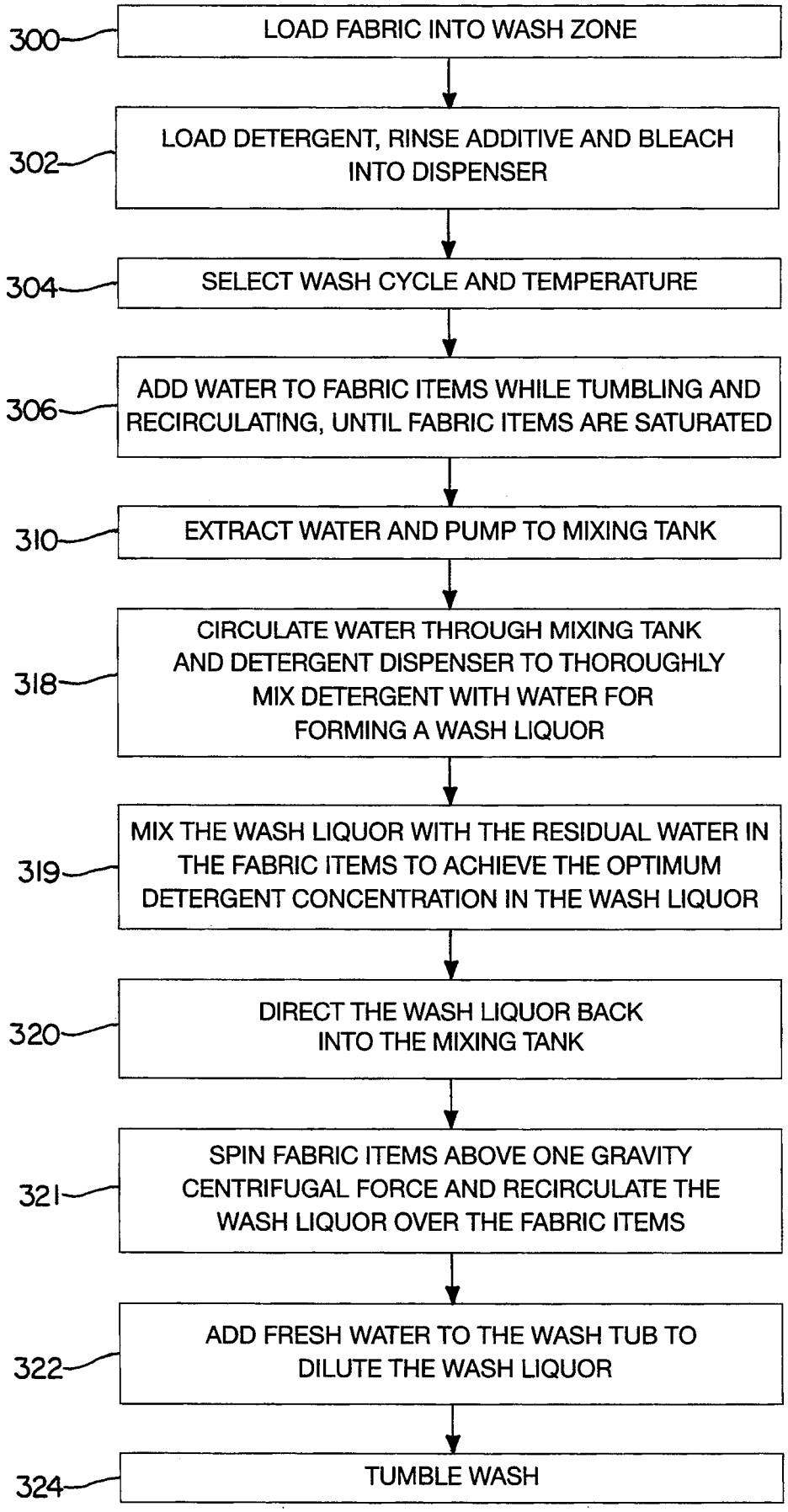
FIG. 6 is a flow chart diagram of the wash cycle of the subject invention.

Turning now to FIG. 6 in combination with FIG. 5, an understanding of the the operation of this second alternative embodiment of the present invention may be understood. Steps 300, 302, 304 and 306 correspond exactly to steps 200, 202, 204, and 206 and therefore need no additional discussion.

In step 310, the wash basket may be spun at a speed to extract the wash liquid from the fabric items after they have been reduced in volume and rolled-up. This extracted wash liquid flows to the collection zone 50 and may be pumped from there to the mixing tank 60 by closing the second three-way valve 82 to redirect the recirculating wash liquid through conduit the 94. A bypass valve 350 is open to allow the wash liquid to flow through conduit 352 to the mixing tank 60. The amount of wash liquid retained in the mixing tank 60 is controlled to equal an optimum quantity of mixing with the detergent. This may be accomplished by providing an overflow conduit 354 for sending to drain all washing liquid exceeding the desired optimum quantity of washing liquid which is sent to the mixing tank 60. A drain valve 83 is closed to keep the wash liquid in the mixing tank 60.

The wash liquid is then recirculated through the mixing tank 60 for forming the concentrated wash liquor as described in step 318. Step 319 and 320 are identical to steps 219 and 220 and therefore need no discussion. In step 322, fresh washing liquid is then added to the wash tub 34 for diluting the wash liquor. The diluted wash liquor is then recirculated over the fabric items as they tumble within the basket as described in step 324.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim:

1. An apparatus for laundering fabric items comprising: a wash tub for receiving a wash liquid;

a rotatable wash basket having a peripheral wall disposed within said wash tub, said fabric items being disposed in said wash basket;

means for introducing an adequate quantity of wash liquid to said wash tub for saturating said fabric items;

means for extracting said wash liquid from said fabric items;

means for mixing a predetermined amount of detergent with a portion of said extracted wash liquid for forming a wash liquor; and means for rotating said wash basket at a speed to effect more than one gravity centrifugal force on said fabric items such that said fabric items are retained against said peripheral wall for a first period of time while continuously passing said wash liquor through said fabric items.

2. An apparatus for laundering fabric items according to claim 1 wherein said means for introducing an adequate quantity of wash liquid to said wash tub for saturating said fabric items further comprises:

means for rotating said wash basket at a speed to effect tumbling of the fabric items within said wash basket;

means for introducing said wash liquid to said tumbling fabric items from a source exterior of said wash tub;

means for recirculating said wash liquid onto said tumbling wash load; and means for determining when said adequate quantity of wash liquid for saturating said fabric items has been introduced.

3. An apparatus for laundering fabric items according to claim 2 wherein said means for determining when said adequate quantity of wash liquid has been introduced further comprising:

means for monitoring the recirculation of said wash liquid onto said tumbling wash load.

4. An apparatus for laundering fabric items according to claim 2 wherein said means for recirculating said wash liquid onto said wash load further comprises:

means for rotating said wash basket alternately in a clockwise and counter clockwise direction to effect tumbling of said fabric items.

5. An apparatus for laundering fabric items according to claim 1 further comprising:

a mixing tank for receiving said extracted wash liquid from said fabric items;

means for sending said extracted wash liquid to said mixing tank;

means for controlling the quantity of extracted wash liquid retained in said mixing tank; and means for adding said predetermined amount of detergent to said mixing tank such that said wash liquor is mixed in said mixing tank.

6. An apparatus for laundering fabric items according to claim 1 further comprises:

a holding tank;

a collection zone for receiving said extracted wash liquid from said fabric items;

means for sending said extracted wash liquid from said collection zone to said holding tank; and means for reintroducing said portion of said extracted wash liquid from said holding tank back into said collection zone for mixing with said predetermined amount of detergent such that said wash liquor is mixed in said collection zone.

7. An apparatus for laundering fabric items according to claim 6 further comprising:

means for diluting said wash liquor with the quantity of wash liquid remaining in said holding tank after said first period of time; and means for rotating said wash basket at a speed to effect tumbling of the fabric items within said wash basket while continuously passing said diluted wash liquor from said collection zone over said fabric items.

8. An apparatus for laundering fabric items according to claim 6, further comprising:

a pump having an inlet and an outlet;

a first conduit interconnecting said pump inlet with said collection zone;

a second conduit selectively interconnecting said pump outlet with said holding tank such that said pump may move said wash liquid from said collection zone to said holding tank;

a spray nozzle; and a third conduit selectively interconnecting said pump outlet with said spray nozzle such that said pump may recirculate said wash liquid through said fabric items by spraying said wash liquid onto said fabric items.

9. An apparatus for laundering fabric items according to claim 8, wherein said means for introducing an adequate quantity of wash liquid for saturating said fabric items further comprising:

means for rotating said wash basket at a speed to effect tumbling of the fabric items within said wash basket;

means for introducing wash liquid to said tumbling fabric items from a source exterior of said wash tub;

means for operating said pump for recirculating said wash liquid onto said tumbling wash load through said third conduit; and means for monitoring the pressure in said third conduit during recirculation for determining when said adequate quantity of wash liquid for saturating said fabric items has been introduced.

10. An apparatus for laundering fabric items according to claim 6 further comprising:

means for determining the total amount of wash liquid introduced into said wash tub; and means for determining the total amount of extracted wash liquid received in said holding tank.

11. An apparatus for laundering fabric items according to claim 10, wherein residual water remains in said clothes after said wash liquid is extracted from said fabric items and further said means for reintroducing a portion of wash liquid from said holding tank back into said collection zone further comprises:

a means for determining the quantity of said portion of reintroduced wash liquid from the total amount of wash liquid introduced into said wash tub and the total amount of extracted wash liquid received in said holding tank such that the combination of said residual wash liquid in said fabric items and said portion of wash liquid reintroduced to said collection zone with said predetermined amount of detergent forms said wash liquor having a predetermined concentration level.

12. An apparatus for laundering fabric items according to claim 11 wherein said predetermined concentration level ranges from 0.5% to 12% by weight.

13. An apparatus for laundering fabric items according to claim 6 further comprising:

a mixing tank for receiving said reintroduced portion of said wash liquid from said holding tank with said predetermined amount of detergent, said wash liquor being mixed in said mixing tank.

14. An apparatus for laundering fabric items according to claim 6 wherein said collection zone is formed into a bottom portion of said wash tub.

15. An apparatus for laundering fabric items comprising: a wash tub for receiving a wash liquid;

a rotatable wash basket having a peripheral wall disposed within said wash tub, said fabric items being disposed in said wash basket;

means for introducing wash liquid to said wash tub;

means for rotating said wash basket at a speed to effect tumbling of the fabric items within said wash basket;

means for recirculating said wash liquid onto said tumbling fabric items;

means for controlling the quantity of wash liquid introduced to said wash tub in response to the quantity required for saturating said fabric items while tumbling said fabric items within said wash basket;

means for mixing a predetermined amount of detergent with a predetermined quantity of said wash liquid for forming a wash liquor; and means for rotating said wash basket at a speed to effect more than one gravity centrifugal force on said fabric items such that said fabric items are retained against said peripheral wall for a first period of time while continuously passing said wash liquor through said fabric items.

16. An apparatus for laundering fabric items according to claim 15, further comprises:

a collection zone formed integral with said wash tub;

means for extracting said wash liquid from said fabric items such that said wash liquid collects in said collection zone;

a mixing tank;

a holding tank;

means for sending said extracted wash liquid from said collection zone to said holding tank; and means for sending a portion of said wash liquid in said holding tank to said mixing tank, said portion sent to said mixing tank being equal to said predetermined quantity of wash liquid for forming a wash liquor;

means for adding said predetermined amount of detergent to said mixing tank for forming said wash liquor.

17. An apparatus for laundering fabric items according to claim 16 further comprising:

means for diluting said wash liquor with the quantity of wash liquid remaining in said holding tank after said first period of time; and means for rotating said wash basket at a speed to effect tumbling of the fabric items within said wash basket while continuously passing said diluted wash liquor from said collection zone over said fabric items.

18. An apparatus for laundering fabric items according to claim 16 further comprising:

means for determining the total amount of wash liquid introduced into said wash tub; and means for determining the total amount of extracted wash liquid received in said holding tank.

19. An apparatus for laundering fabric items according to claim 18 wherein residual water remains in said clothes after said wash liquid is extracted from said fabric items and further said means for reintroducing a portion of wash liquid from said holding tank back into said collection zone further comprises:

a means for determining the quantity of said portion of reintroduced wash liquid from the total amount of wash liquid introduced into said wash tub and the total amount of extracted wash liquid received in said holding tank such that the combination of said residual wash liquid in said fabric items and said portion of wash liquid reintroduced to said collection zone with said predetermined amount of detergent forms said wash liquor having a predetermined concentration level.

20. A method of laundering fabric items in a washing apparatus including a perforate rotatable wash basket disposed within a wash tub, said wash basket having a peripheral wall defining a wash zone, means for rotating said wash basket about a horizontal axis, said method comprising the steps:

introducing said fabric items into said wash basket;

introducing wash liquid into said wash tub for saturating said fabric items with said wash liquid;

extracting said wash liquid from said fabric items;

mixing a predetermined amount of detergent with a determined portion of said extracted wash liquid for forming a wash liquor;

rotating said wash basket at a speed to effect more than one gravity centrifugal force on said fabric items such that said fabric items are retained against said peripheral wall for a first period of time; and continuously passing said concentrated wash liquor through said fabric items.

21. A method of laundering fabric items in a washing apparatus according to claim 20 wherein said washing apparatus further comprises a mixing tank, said method further comprising:

sending said extracted wash liquid to said mixing tank;

controlling the quantity of extracted wash liquid retained in said mixing tank to equal said determined portion of said extracted wash liquid; and adding said predetermined amount of detergent to said mixing tank such that said wash liquor is mixed in said mixing tank.

22. A method of laundering fabric items in a washing apparatus according to claim 20 wherein said washing apparatus, includes a holding tank and a collection zone, said collection zone being formed in said wash tub, said method further comprising:

sending said extracted wash liquid to said holding tank for storing said extracted wash liquid; and sending said determined portion of said extracted wash liquid from said holding tank to said collection zone for mixing with said predetermined amount of detergent.

23. A method of laundering fabric items in a washing apparatus according to claim 20 wherein said washing apparatus further comprises a mixing tank and a holding tank, said method further comprising:

sending said extracted wash liquid to said holding tank for storing said extracted wash liquid;

sending said determined portion of said extracted wash liquid from said holding tank to said mixing tank; and adding said predetermined amount of detergent to said mixing tank for forming said wash liquor.

24. A method of laundering fabric items in a washing apparatus according to claim 23 wherein residual wash liquid remains in said clothes after said wash liquid is extracted from said fabric items, said method further comprising:

recirculating said washing liquor formed in said mixing tank through said fabric items; while rotating said wash basket at a speed just sufficient to prevent tumbling within said wash basket such that said residual water in said fabric items is mixed with said wash liquid formed in said mixing tank to provide said wash liquor with a predetermined detergent concentration; and sending said wash liquid to said mixing tank after a predetermined period of time.

25. A method of laundering fabric items in a washing apparatus according to claim 23 wherein residual wash liquid remains in said fabric items after said wash liquid is extracted from said fabric items further comprising:

determining the total quantity of wash liquid used for saturating said fabric items;

determining the total quantity of wash liquid extracted from said fabric items and stored in said holding tank;

determining the quantity of said determined portion of extracted wash liquid from the total amount of wash liquid introduced into said wash tub for saturating said fabric items and the total amount of extracted wash liquid received in said holding tank such that the combination of said residual wash liquid in said fabric items and said determined portion of extracted wash liquid sent to said mixing tank with said predetermined amount of detergent forms said wash liquor having a predetermined concentration level.

26. A method for laundering fabric items in a washing apparatus according to claim 20 wherein said step introducing wash liquid into said wash tub for saturating said fabric items with wash liquid further comprises:

rotating said wash basket at a speed to effect tumbling of the fabric items within said wash basket;

introducing said wash liquid to said tumbling fabric items from a source exterior of said wash tub;

recirculating said wash liquid onto said tumbling wash load; and monitoring recirculation for determining when said adequate quantity of wash liquid for saturating said fabric items has been introduced.

27. A method of laundering fabric items in a washing apparatus according to claim 26 wherein said step of recirculating said wash liquid onto said tumbling wash load further comprising:

recirculating said wash liquid over said fabric items while rotating said wash basket alternately in a clockwise and counter clockwise direction to effect tumbling of said fabric items.

28. A method of laundering fabric items in a washing apparatus according to claim 26 wherein said washing apparatus further includes a pump interconnected with said wash tub and further interconnected with a plurality of conduits such that wash liquid within said wash tub may be recirculated over said fabric items, the method of introducing said wash liquid to said wash tub from a source exterior of said washing apparatus further comprising:

monitoring the pressure in said plurality of conduits during recirculation of said wash liquid over said fabric items; and terminating the introduction of wash liquid to said wash tub when the pressure in said plurality of conduits reaches a predetermined limit.

29. A method of laundering fabric items in a washing apparatus including a perforate rotatable wash basket disposed within a wash tub, said wash basket having a peripheral wall defining a wash zone, means for rotating said wash basket about a horizontal axis, said method comprising the steps:

introducing said fabric items into said wash basket;

introducing wash liquid to said wash tub for saturating said fabric items;

rotating said wash basket at a speed to effect tumbling of the fabric items within said wash basket;

recirculating said wash liquid onto said tumbling fabric items;

subsequently, combining a predetermined amount of detergent with a portion of said wash liquid for forming a wash liquor having a detergent concentration level within a predetermined range; and rotating said wash basket at a speed to maintain said fabric items against said peripheral wall and continuously passing said wash liquor through said fabric items for a first period of time.

30. A method of laundering fabric items in a washing apparatus according to claim 29, wherein said washing apparatus includes a collection zone for receiving said wash liquid and a holding tank, the step of combining a predetermined amount of detergent with a portion of said was liquid for forming a wash liquor having a detergent concentration level within a predetermined range further comprising:

extracting said wash liquid from said fabric items such that said wash liquid collects in said collection zone;

sending said extracted wash liquid from said collection zone to said holding tank;

reintroducing a portion of said wash liquid from said holding tank back into said collection zone; and mixing a predetermined amount of detergent with said portion of said wash liquid in said collection zone.

31. A method of laundering fabric items in a washing apparatus according to claim 30 wherein residual wash liquid remains in said clothes after said wash liquid is extracted from said fabric items, said method further comprising:

recirculating said washing liquid formed in said collection zone through said fabric items; while rotating said wash basket at a speed just sufficient to prevent tumbling within said wash basket such that said residual water in said fabric items is mixed with said wash liquid formed in said mixing tank to provide said wash liquor with a predetermined detergent concentration; and sending said wash liquid to said collection zone after a predetermined period of time.

32. A method of laundering fabric items in a washing apparatus according to claim 30 further comprising:

diluting said wash liquor with the quantity of wash liquid remaining in said holding tank after said first period of time; and rotating said wash basket at a speed to effect tumbling of the fabric items within said wash basket while continuously passing said diluted wash liquor from said collection zone over said fabric items.

33. A method of laundering fabric items in a washing apparatus according to claim 30 further comprising:

determining the total amount of wash liquid introduced into said wash tub; and determining the total amount of extracted wash liquid received in said holding tank.

34. A method of laundering fabric items in a washing apparatus according to claim 33 wherein residual water remains in said clothes after said wash liquid is extracted from said fabric items, said step of reintroducing a portion of wash liquid from said holding tank back into said collection zone further comprises:

determining the quantity of said portion of reintroduced wash liquid from the total amount of wash liquid introduced into said wash tub and the total amount of extracted wash liquid received in said holding tank such that the combination of said residual wash liquid in said fabric items and said portion of wash liquid reintroduced to said collection zone with said predetermined amount of detergent forms said wash liquor having said detergent concentration level within said predetermined range.

35. A method for laundering fabric items according to claim 29 further comprising:

controlling the quantity of wash liquid introduced to said wash tub in response to the quantity required for saturating said fabric items while tumbling said fabric items within said wash basket and recirculating said wash liquid over said fabric items.

36. An apparatus for laundering fabric items comprising: a wash tub for receiving a wash liquid;

a rotatable wash basket having a peripheral wall disposed within said wash tub, said fabric items being disposed in said wash basket;

a collection zone formed into said wash tub;

a holding tank;

a mixing tank;

means for introducing an adequate quantity of wash liquid to said wash tub for saturating said fabric items;

means for extracting said wash liquid from said fabric items into said collection zone;

means for sending said extracted wash liquid from said collection zone to said holding tank;

means for sending a portion of said wash liquid from said holding tank into said mixing tank along with a predetermined amount of detergent such that said portion of said wash liquid and said detergent form a wash liquor;

means for sending said wash liquor from said mixing tank into said wash tub; and means for rotating said wash basket at a speed to effect more than one gravity centrifugal force on said fabric items such that said fabric items are retained against said peripheral wall for a first period of time while continuously passing said wash liquor from said collection zone through said fabric items.

37. An apparatus for laundering fabric items according to claim 36 wherein said means for introducing an adequate quantity of wash liquid to said wash tub for saturating said fabric items further comprises:

means for rotating said wash basket at a speed to effect tumbling of the fabric items within said wash basket;

means for introducing said wash liquid to said tumbling fabric items from a source exterior of said wash tub;

means for recirculating said wash liquid onto said tumbling wash load;

means for monitoring recirculation for determining when said adequate quantity of wash liquid for saturating said fabric items has been introduced.

38. An apparatus for laundering fabric items according to claim 36 further comprising:

a pump having an inlet and an outlet;

a first conduit interconnecting said pump inlet with said collection zone;

a second conduit interconnecting said pump outlet with said holding tank such that said pump may move said wash liquid from said collection zone to said holding tank;

a spray nozzle;

a third conduit interconnecting said pump outlet with said spray means such that said pump may recirculate said wash liquid through said fabric items by spraying said wash liquid onto said fabric items; and means for controlling wash liquid flow through said second and said third conduits.

39. An apparatus for laundering fabric items according to claim 38, wherein said means for introducing an adequate quantity of wash liquid for saturating said fabric items further comprising:

means for rotating said wash basket at a speed to effect tumbling of the fabric items within said wash basket;

means for introducing wash liquid to said tumbling fabric items from a source exterior of said wash tub;

means for operating said pump for recirculating said wash liquid onto said tumbling wash load through said third conduit; and means for monitoring the pressure in said third conduit during recirculation for determining when said adequate quantity of wash liquid for saturating said fabric items has been introduced.

40. An apparatus for laundering fabric items according to claim 38 wherein a quantity of residual wash liquid remains in said clothes after said wash liquid is extracted from said clothes, further comprising:

means for determining the total amount of wash liquid introduced into said wash tub; and means for determining the total amount of extracted wash liquid received in said holding tank.

41. An apparatus for laundering fabric items according to claim 40 wherein said portion of wash liquid sent from said holding tank into said mixing tank is determined from the total amount of wash liquid introduced into said wash tub and the total amount of extracted wash liquid received in said holding tank such that the sum of said residual wash liquid in said fabric items and said portion of wash liquid reintroduced to said collection zone equals a predetermined quantity of wash liquid for forming said concentrated wash liquor having a detergent concentration within a predetermined range.

42. An apparatus for laundering fabric items according to claim 38 wherein said predetermined range of detergent concentration levels is between 0.5% and 12% by weight.

* * * * *